US005362006A

United States Patent [19]

Richerson et al.

[11] Patent Number: 5,362,006

[45] Date of Patent: Nov. 8, 1994

[54] SEGMENT REMOVAL ASSEMBLY FOR WINDING MACHINE

[75] Inventors: James D. Richerson, Versailles; Stephen D. Smith, Lawrenceburg; George W. Springtube, Louisville, all of Ky.

[73] Assignee: Kuhlman Corporation, Lexington, Ky.

[21] Appl. No.: 24,236

[22] Filed: Feb. 26, 1993

[51] Int. Cl.[5] ..... B65H 81/02; B65H 1/00

[52] U.S. Cl. ..... 242/4 BE; 242/4 C; 414/225; 414/786

[58] Field of Search ..... 242/4 B, 4 BE, 4 C, 242/7.09; 414/225, 222, 736, 786, 910, 911; 29/605

[56] References Cited

U.S. PATENT DOCUMENTS

| | | | |
|---|---|---|---|
| 1,319,695 | 10/1919 | Converse | 242/4 B |
| 1,603,801 | 10/1926 | Potter | 242/4 BE |
| 1,679,804 | 8/1928 | Bisel et al. | 242/4 BE |
| 2,444,126 | 6/1948 | Wirth | 242/4 B |
| 2,588,139 | 3/1952 | McCarthy | 242/4 B |
| 3,125,307 | 3/1964 | Buralli | 242/4 B |
| 3,125,308 | 3/1964 | Buralli | 242/4 B |
| 3,180,583 | 4/1965 | Dorn et al. | 242/4 B |
| 3,383,059 | 5/1968 | Fahrbach | 242/4 C |
| 3,459,385 | 8/1969 | Fahrbach | 242/4 B |
| 4,007,881 | 2/1977 | Haslau et al. | 242/4 B |
| 4,637,563 | 1/1987 | Arii et al. | 242/4 B |
| 4,725,009 | 2/1988 | Fahrbach | 242/4 B |
| 4,732,339 | 3/1988 | Bridges | 242/4 BE |
| 4,775,271 | 10/1988 | Maccaferri | 414/225 |
| 4,781,512 | 11/1988 | Ohta et al. | 414/222 |
| 4,884,758 | 12/1989 | Hamkins | 242/4 BE |
| 5,257,689 | 11/1993 | Lombardi et al. | 414/736 X |

*Primary Examiner*—Daniel P. Stodola
*Assistant Examiner*—Michael R. Mansen
*Attorney, Agent, or Firm*—Townsend and Townsend Khourie and Crew

[57] ABSTRACT

A segment removal assembly (46) includes a segment removal device which automatically grasps removable segments (48, 50) of shuttle and magazine rings (8, 10) of a winding machine (2), removes the segments to a displaced position leaving segment gaps (66) in the rings and, after the interior (146) of the rings are accessed by removing and inserting a portion of a transformer core (34) from and into the interior of the rings at a load/unload station (158), the segments are replaced back into the segment gaps and resecured to remainders (52, 54) of the rings. This is accomplished using pivotal arms (110, 112, 132, 134) which engage pins (80) carried by the ring segments. Grasping the pins unlatches the segments from the remainders of the rings thus permitting the segments to be removed from the remainders of the rings. Two or more cores can be mounted to a movable common support (160) to allow one core to be wound with wire while the other core is repositioned on the common support or another core is mounted to the common support.

17 Claims, 12 Drawing Sheets

SEGMENT REMOVAL ASSEMBLY FOR WINDING MACHINE

BACKGROUND OF THE INVENTION

Conventional toroidal coil winding machines use a shuttle ring and a magazine ring adjacent one another to wind wire about the toroidal core. Examples of such coil winding machines are found in Fahrbach, U.S. Pat. Nos. 3,383,059; 3,459,385 and 4,725,009, the disclosures of which are incorporated by reference. Such machines are sold by Universal Manufacturing Company, Inc. of Irvington, N.J. 07111.

One of the concerns with conventional coil winding machines is how to get that part of the core to be wound with the wire into the center of the rings so that the wire (or other material) can be wound around it. One way to do so is to wind toroidal segments one half at a time. See U.S. Pat. No. 4,884,758 to Hamkins, the disclosure of which is incorporated by reference. Another method is to make the shuttle and magazine rings with removable segments. See, for example, U.S. Pat. No. 2,588,139, to McCarthy.

SUMMARY OF THE INVENTION

The present invention is directed to a segment removal assembly for winding machines which permits shuttle and magazine ring segments to be automatically removed under control of the controller used to operate the coil winding machine. This permits the coil segments to be quickly removed by the segment removal assembly, the rings (with gaps) to be rotated to permit access to the interior of the rings and the rings to be returned to the position opposite the segment removal assembly for replacement of the ring segments. The rings can then be automatically rotated to their home positions to start another winding operation sequence. Since the entire sequence is under the control of the controller for the coil winding machine, there is no loss of control of the position of the shuttle ring gear since the shuttle ring gear position remains under control of the controller during the entire operation. This saves a tremendous amount of time which would otherwise have to be spent in realigning and rezeroing the machine each time ring segments are removed.

The segment removal assembly includes a segment removal device which automatically grasps removable segments of the shuttle and magazine rings of the winding machine, removes the segments to a displaced position leaving a segment gap in the rings and, after the interior of the rings are accessed, typically by inserting or removing a portion of a core of a transformer into or from the interior of the rings, replaces the segments back into the segment gaps and secures the segments to the remainders of the rings. This is preferably accomplished using pivot arms, mounted to a base, which engage axially extending segment support pins carried by the ring segments. The arms are preferably driven between pin engaged and pin disengaged positions by piston and cylinder arrangements, also mounted to the base. Grasping the support pins also unlatches the segments from the remainders of the rings thus permitting the segments to be removed from the rings. This typically occurs by moving the base, to which the pivot arms and piston and cylinder actuators are mounted, and the segments secured to the pivot arms.

An advantage of the invention is that the action of engaging the segment support pins also acts to unlock the ring segments from the remainders of the rings. In the preferred embodiment the segment support pins are each a rigid extension of a circumferentially extending, spring biased ring latching pin. The act of grasping the segment support pin pushes the ring latching pin against the biasing force of a latching spring thus disengaging the latching pin from a mating opening in the remainder of the ring.

Another aspect of the invention relates to positioning toroidal transformer cores at the winding position of the winding machine with the use of a common support. In the preferred embodiment, the common support is a turntable arrangement that supports two core support assemblies. The core support assemblies are indexed between a first, wire-winding position and a second, core removal and replacement position. In this way, while one core is being wound with wire at the first wire winding position, the previously wire-wound core, at the second position, can be removed from its core support assembly and repositioned on the core support assembly or a new toroidal transformer core can be mounted to the core support assembly in its place. This helps eliminate down time of the wire winding machine which would otherwise occur while removing a wound core and replacing it with a new, unwound core.

Other features and advantages of the invention will appear from the following description in which the preferred embodiment has been set forth in detail in conjunction with the accompanying drawings.

DESCRIPTION OF THE PREFERRED EMBODIMENT

Figure 1:
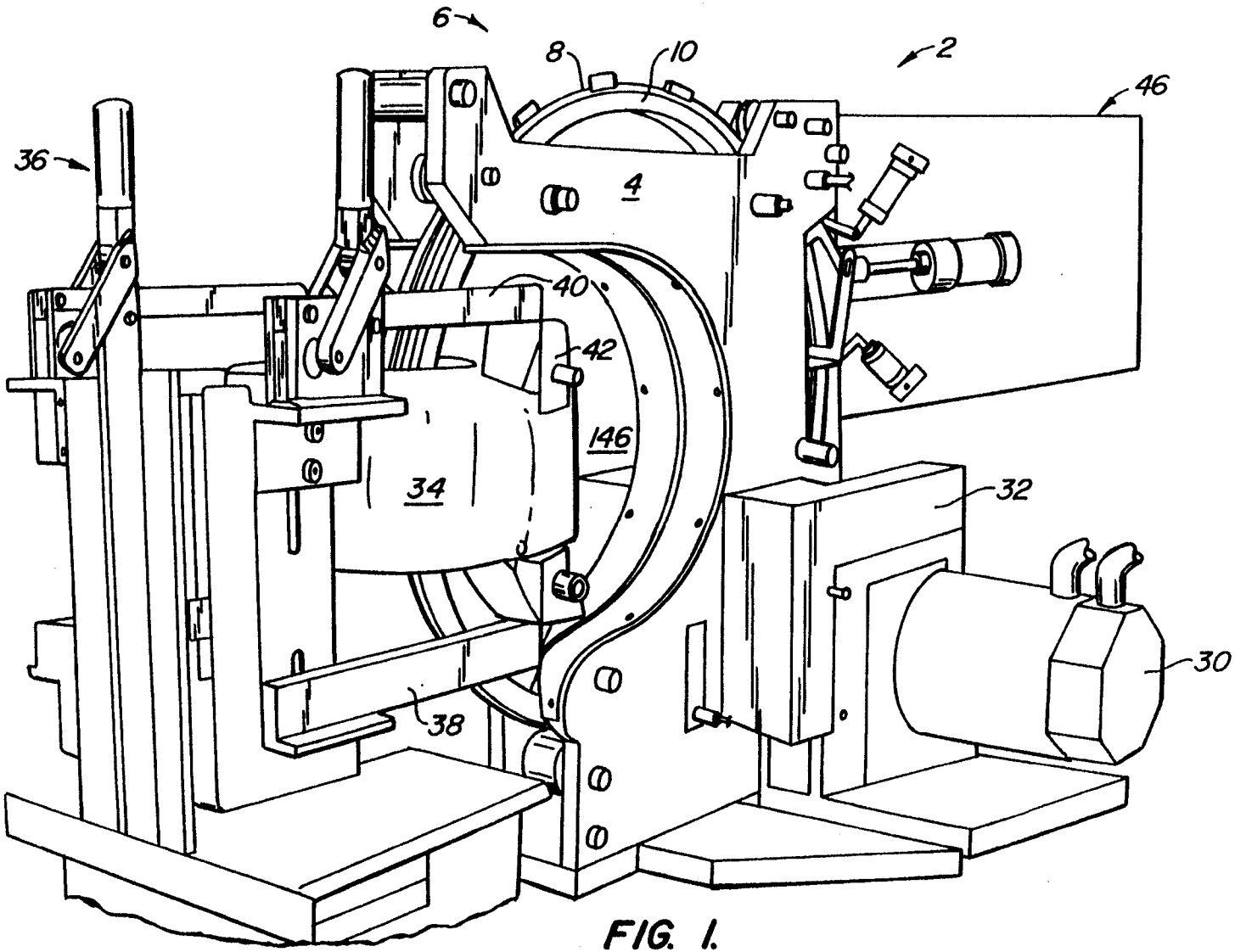
FIG. 1 is an overall perspective view showing a coil winding machine used with a segment removal assembly made according to the invention.
Figure 3B:
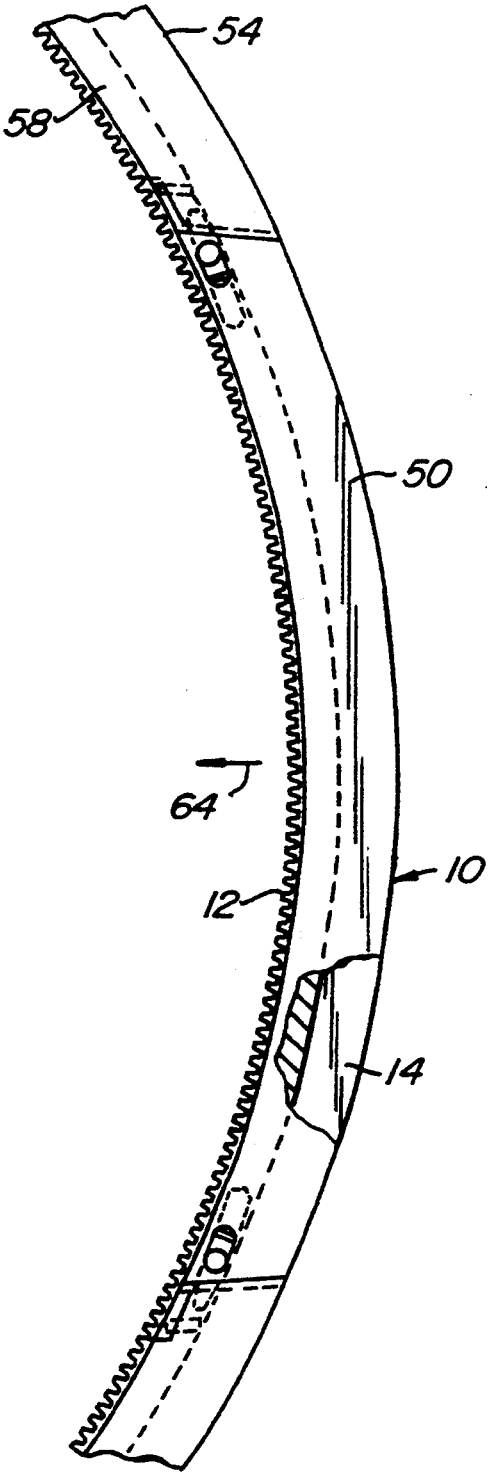
FIG. 3B is a side view of the ring portion of FIG. 3A.
Figure 3A:
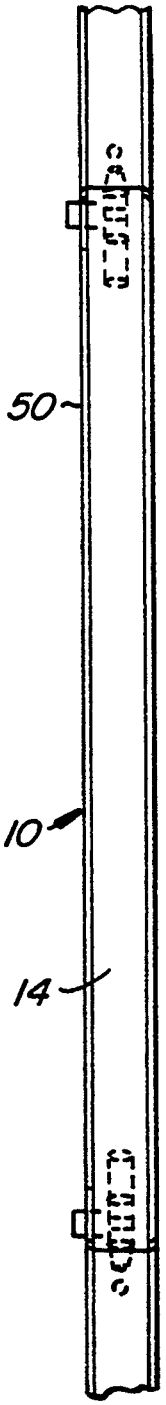
FIG. 3A is a side view of a portion of the wire magazine ring including its removable segment.
Figure 5:
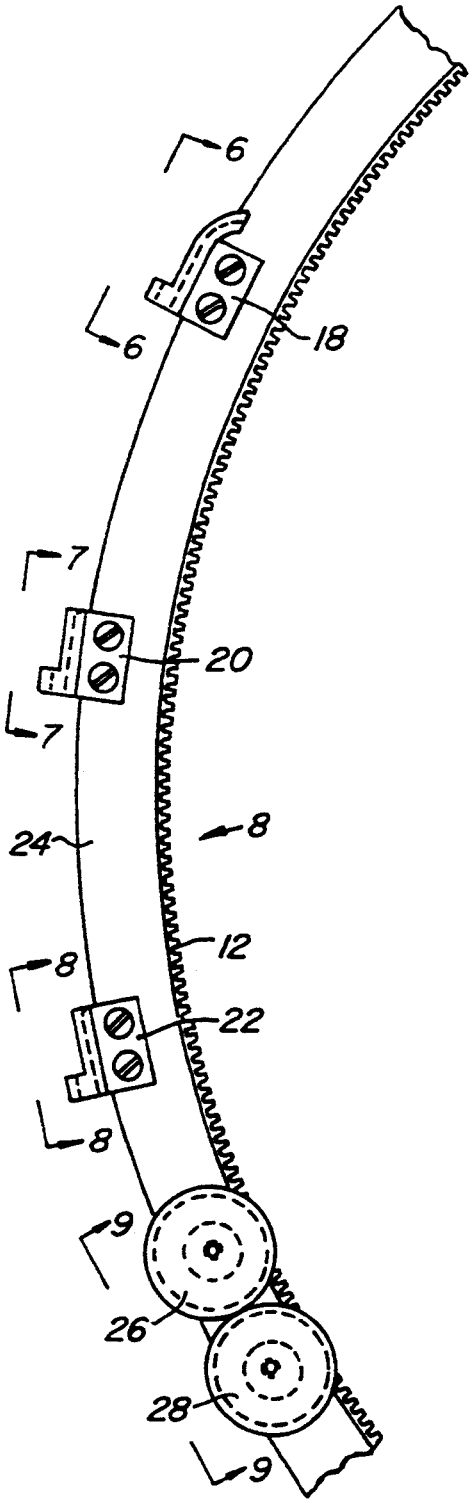
FIG. 5 is a side view of a portion of the shuttle ring of FIG. 1.
Figure 6:
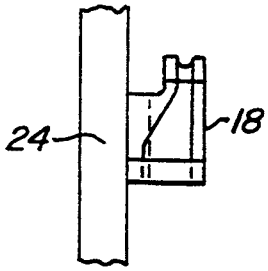
FIGS. 6 through 9 are side views of portions of shuttle ring 8 taken along lines 6—6 through 9—9.
Figure 7:
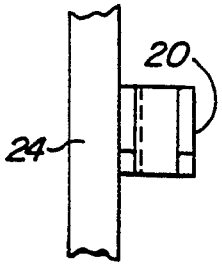
Figure 8:
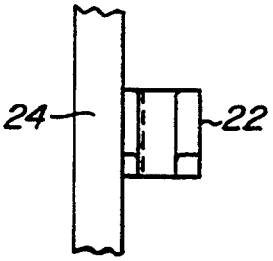
Figure 9:
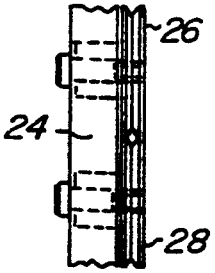
Figure 3C:
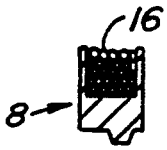
FIG. 3C is a cross-sectional view of the ring of FIG. 3A shown filled with wire.

FIG. 1 illustrates a generally conventional coil winding machine 2 of the type having a frame 4 to which a winding head assembly 6 is mounted. Winding head assembly 6 includes a shuttle ring 8 and a wire magazine ring 10 both of which are rotatably mounted to frame 4. Rings 8, 10 each include an internal ring gear 12. Magazine ring 10, as shown in FIGS. 3A, 3B and 3C, includes a cavity 14 which houses a supply of wire 16 used for winding operations, as is conventional. Shuttle ring 8, as shown in FIGS. 5–9, includes a wire pick-up guide 18, an intermediate wire guide 20 and a final wire guide 22 all secured to shuttle ring body 24. Wire guides 18–22 pick up and guide wire 16 from magazine ring 10 and direct it between a pair of wire winding pulleys 26, 28 during winding operations.

Rings 8, 10 are independently driven by a drive motors 30 under control of the controller 32. Controller 32 is generally conventional, such as made by Allen-Bradley of Milwaukee, Wis. as PLC 5/20. Controller 32 is designed to be programmed by the user to accomplish the desired winding sequence for the particular geometries, wire tension, spacing, etc. Also shown in FIG. 1 is a toroidal transformer core 34 shown mounted to a rotating, indexing core support assembly 36 using a pair of manually-actuated clamp arms 38, 40 on each side of rings 8, 10. Clamp arms 38, 40 engage core blocking 42 mounted to the ends of core 34. The clamping and unclamping of arms 38, 40 of core support assembly 36 is under control of the operator.

Figure 2:
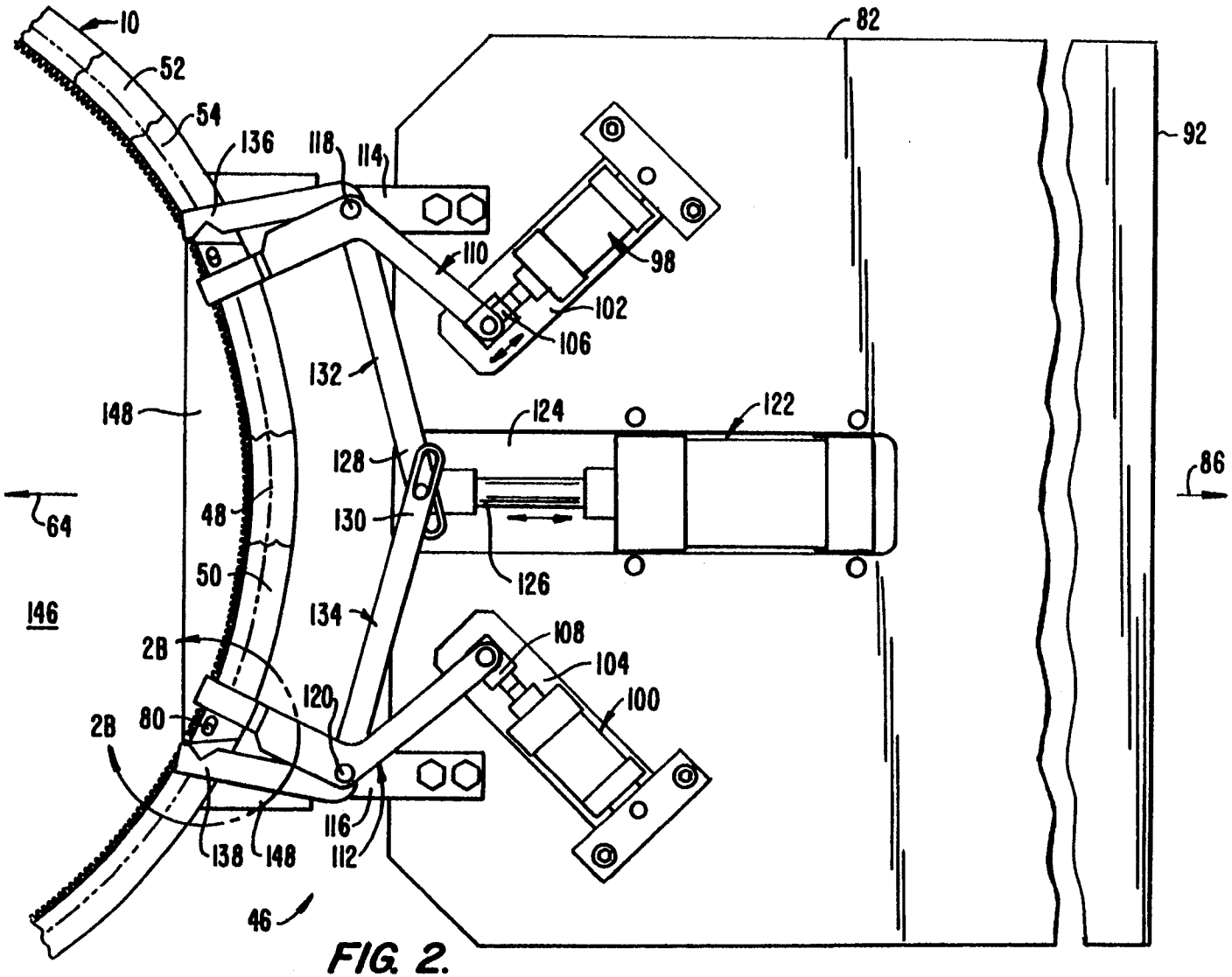
FIG. 2 is a side view of the segment removal assembly of FIG. 1, together with a portion of the shuttle and wire magazine rings, with the segment removal assembly moved towards the rings but prior to the arms engaging the segment support pins.

The above components described are generally conventional. The present invention relates to modifications in rings 8, 10 shown in FIGS. 2–4 and the use of a segment removal assembly 46, shown in FIGS. 2 and 2A, used to automatically remove and replace segments 48, 50 of rings 8, 10.

Figure 4:
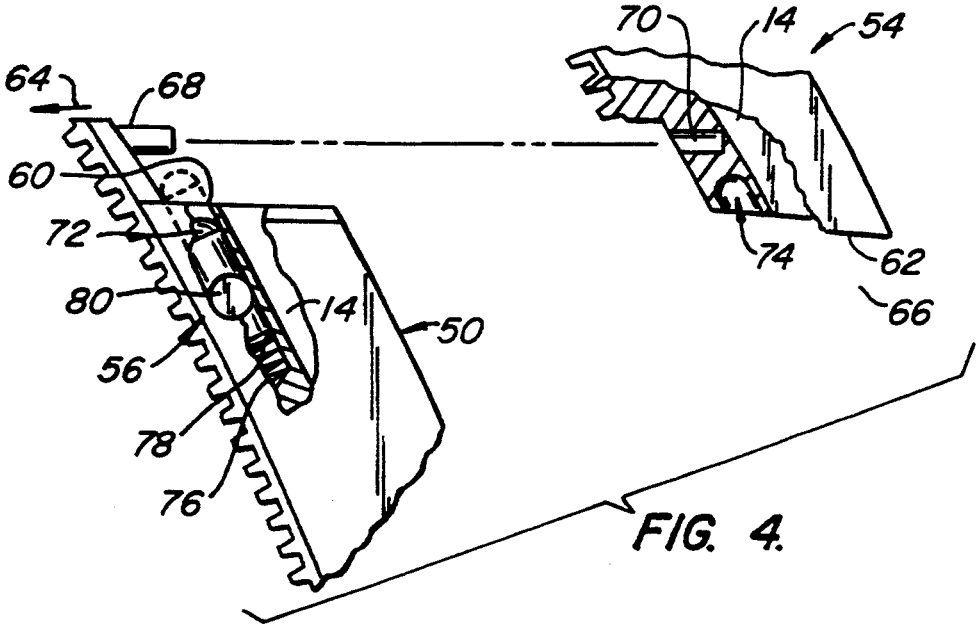
FIG. 4 is an enlarged side view of portions of the wire magazine ring of FIG. 3B at the interface between the segment and the remainder of the ring with the segment moved towards an access position from the use position of FIG. 3B.

Segments 48, 50 are secured to the remainders 52, 54 of rings 8, 10 using combination pin assemblies 56 shown in FIGS. 3A–4. Since combination pin assemblies 56 are the same for both rings 8 and 10, only their use with removable segment 50 of wire magazine ring 10 will be described, recognizing that the construction and manipulation of segment 48 will be similar.

Magazine ring 10 has a magazine ring body 58 into which internal ring gear 12 is formed. Segment 50 and remainder 54 define tapered interfaces 60, 62 configured to permit segment 50 to move radially inwardly, that is in the direction of arrow 64, to remove segment 50 from remainder 54 of magazine ring 10 thus leaving a gap 66. Proper positioning of segment 50 with remainder 54 is achieved by the configuration of interfaces 60, 62 and also through the use of a guide pin 68 extending from segment 50 along interface 60 which engages a mating hole 70 formed in remainder 54.

Segment 50 is secured or locked in its use position of FIG. 3B through the use of a combination pin assembly 56 at each end of segment 50. Pin assembly 56 includes a ring latching pin 72 extending from interface 60. Pin 72 is sized and positioned to engage a complementary hole 74 extending into body 58 of remainder 54. The engagement of pin 72 within hole 74 ensures proper alignment of segment 50 with remainder 54 when pin 72 is fully engaged within hole 74. Pin 72 is mounted within a hole 76 formed in segment 50 and is biased towards hole 74 by a latch spring 78. Pin 72 is moved along hole 76 against spring 78 through the use of an axially extending segment support pin 80. Pin 80 is a one-piece, integral extension of pin 72 and is used, as discussed below, to both manipulate pin 72 between its latched position, shown in FIG. 3B, and its released position, shown in solid lines in FIG. 4, and to permit segment 10 to be grasped and moved from the use position of FIG. 3B and the access position of FIG. 4 as is discussed below.

Segment removal assembly 46 includes a base 82 mounted to frame 4 through a frame extension 84 and a pair of guide tubes, not shown, which permit base 82 to move in inward radial direction 64 and in outward radial direction 86. The inward and outward movement of base 82 is achieved using a double acting base drive piston and cylinder actuator 88. One end 90 of actuator 88 is connected to the outer end 92 of base 82 by a connecting block 94. The other end 96 of actuator 88 is connected to frame extension 84 by a connecting block 97. Accordingly, actuation of cylinder 88, as discussed below, can cause base 82 to move in either inward radial direction 64 or outward radial direction 86.

Assembly 46 also includes a pair of outer arm actuators 98, 100 which are mounted within openings 102, 104 formed in base 82. Actuators 98, 100, shown also in FIG. 10, have rods 106, 108 connected to dog leg shaped outer arms 110, 112. Arms 110, 112 are pivotally mounted to extensions 114, 116 of base 82 at pivots 118, 120.

Assembly 46 also includes an inner arm actuator 122 mounted within a central opening 124 formed in base 82. Actuator 122 has an actuator rod 126 to which the inner ends 128, 130 of inner arms 132, 134 are secured. Arms 132, 134 are also secured to base 82 at pivots 118, 120.

Outer arms 132, 134 have notches 140 formed in their outer ends 136, 138. Notches 140 are sized to engage segment support pins 80 to enable arms 110, 112, 132, 134 to grasp and remove sections 48, 50. To do so, base 82 is moved in radial direction 64 by actuator 88 and then outer arm actuator 122 is actuated pivoting ends 136, 138 of outer arms 132, 134 towards pins 80. Note that during removal of sections 48, 50, actuators 98, 100 do not pivot inner arms 110, 112; rather, inner arms 110, 112 remain stationary and pins 80 are driven against arms 110, 112 by arms 132, 134. Arms 132, 134 thus move from the position of FIGS. 2 and 2B to the position of FIG. 2C. In viewing FIGS. 2B and 2C, it can be seen that outer ends 136, 138, in addition to grasping segment support pins 80, also move tapered ring latching pins 72 away from holes 74 so to release segment 50 from remainder 54 of wire magazine ring 10. After this removal, segment 50 is moved from the use position of FIG. 2 to the access position of FIG. 4, at which gap 66 is left in ring 10.

Figure 2A:
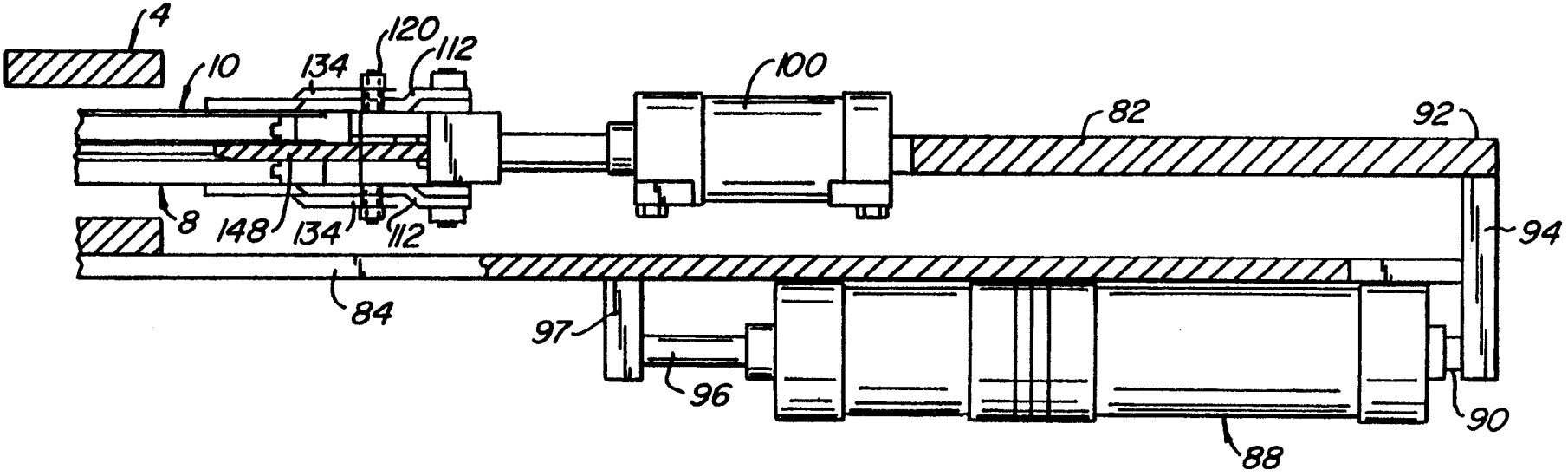
FIG. 2A is a somewhat simplified side view of the assembly of FIG. 2.
Figure 2B:
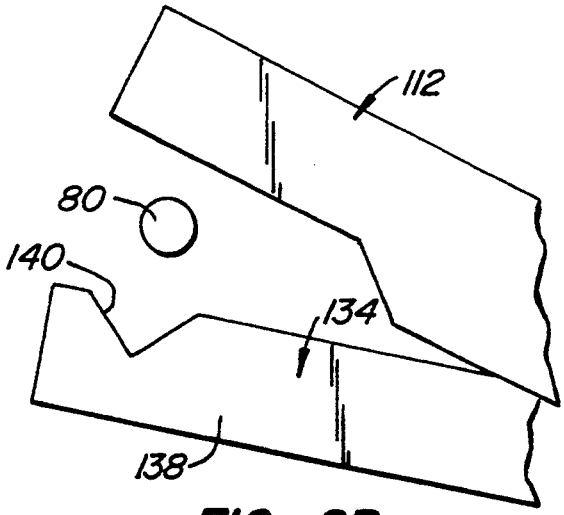
FIG. 2B is an enlarged, simplified view taken along line 2B—2B of FIG. 2 showing the ends of the clamp arms on either side of the segment grasping pin before engaging the segment grasping pin and with the segment grasping pin in the latched position.
Figure 2C:
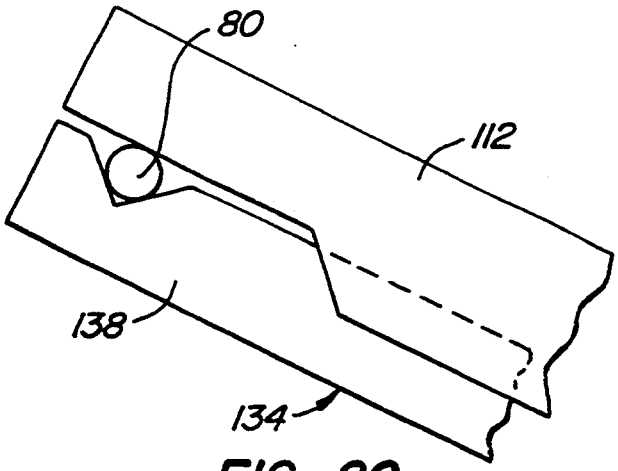
FIG. 2C is similar to FIG. 2B but shows the segment grasping pin engaged by the arms and moved to the released position.
Figure 10:
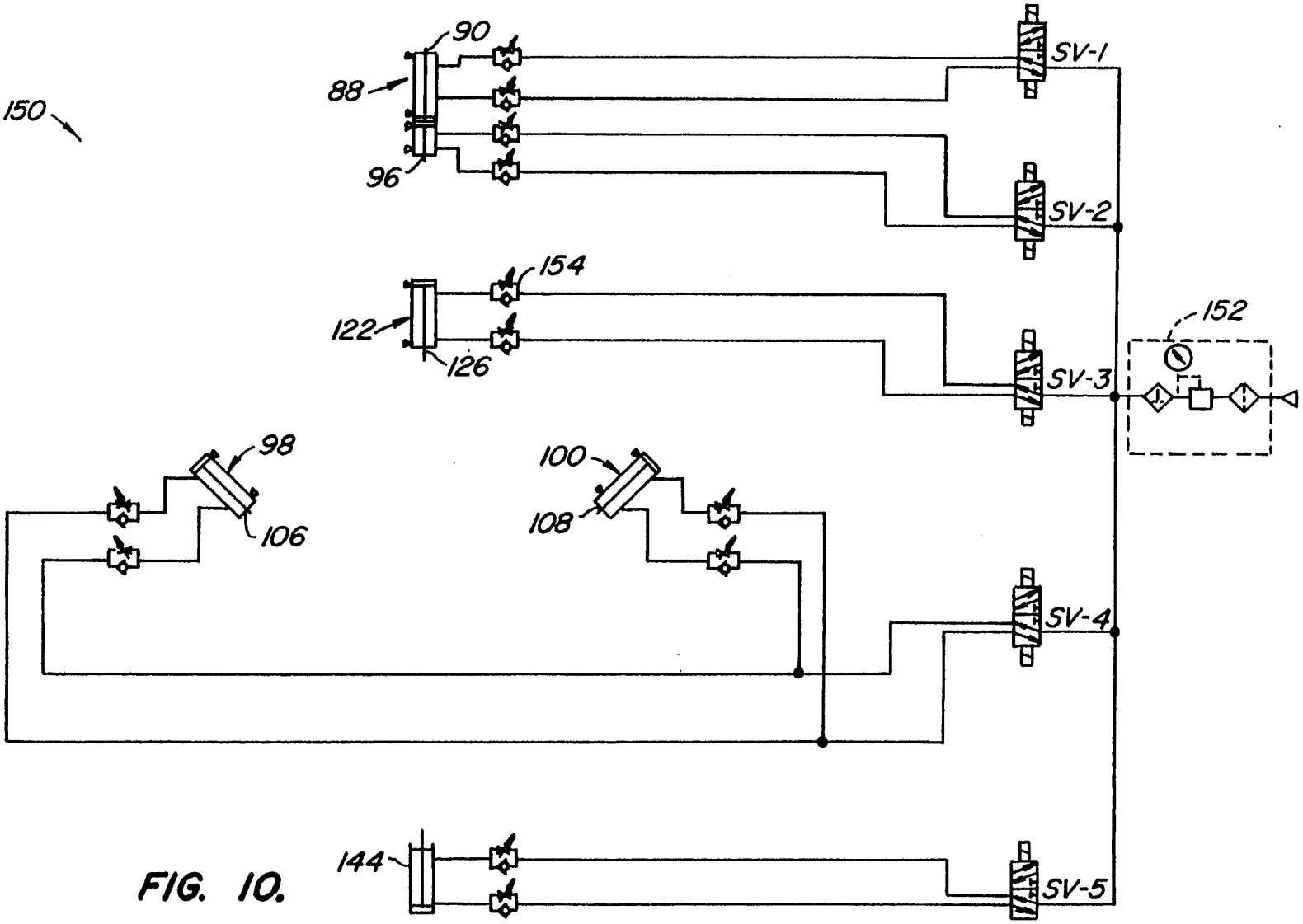
FIG. 10 is a schematic fluid power diagram illustrating the arrangement of the various actuators used with the segment removal assembly of FIGS. 2 and 2A and the rotary indexing core support assembly of FIG. 1.

As can be seen from FIG. 2A, two sets of arms 110, 112, 132, 134 are used with actuators 98, 100, 122, one set positioned on one side of base 82 and the other set on the other side so to engage shuttle and wire magazine rings 8, 10. Once segments 48, 50 are in the access positions of FIG. 4, remainders 52, 54 of rings 8, 10 can be rotated by controller 32 until gaps 66 are aligned with core 34. Core clamp cylinder 144, see FIG. 10, is then actuated by controller 32 to permit assembly 36 to be moved taking core 34 with it, the core passing through gaps 66 in rings 8, 10. The operator then releases arms 40, 38 from core blocking 42 to permit core 34 to be repositioned or replaced. Once that is accomplished, assembly 36 is moved to reposition core 34 within the interior 146 of rings 8, 10. Controller 32 then actuates core clamp cylinder 144 to secure assembly 36 in position and rotates remainders 52, 54 of rings 8, 10 back to the positions of FIG. 2 opposite assembly 46. Controller 32 then actuates actuator 88 to move base 82 and segments 48, 50 therewith in outward radial direction 86 to move the segments from the access position of FIG. 4 to the use position of FIG. 2. When in the use position, that is with segments 48, 50 aligned with remainders 52, 54 of rings 8, 10, actuators 98, 100, 122 are actuated to pivot arms 110, 112 towards pins 80 and arms 132, 134 away from pins 80. Note that arms 110, 112 are used to drive combination pin assemblies 56 back towards remainders 52, 54 of rings 8, 10 and into holes 74 in case springs 76 do not do so, which could occur, for example, due to a small misalignment of the parts. Actuators 98, 100 are then actuated to pivot arms 110, 112 away from pins 80. Actuator 88 is then actuated again thus moving base 82 in outward radial direction 86 so to completely separate assembly 46 from rings 8, 10.

Base 82 includes a ring segment separator 148 positioned to fit between segments 48, 50 during the removal and replacement of segments 48, 50. Separator 148 helps to keep segments 48, 50 properly aligned when the segments are removed from remainders 52, 54 of rings 8, 10.

FIG. 10 is a schematic diagram of a control circuit 150 used with the present invention- Control circuit 150 includes a number of shuttle valves SV-1 through SV-5 which are actuated under the control of controller 32. Shuttle valves SV-1 through SV-5 are supplied with pressurized fluid from a pressurized fluid source 152. The air passes through the shuttle valves, through conventional flow controllers 154 and into the various actuators.

Briefly, the operation of the invention, under control of controller 32, proceeds as follows. Rings 8, 10 are rotated until segments 48, 50 are aligned with segment removal assembly 46. Base 82 is then moved by base drive actuator 88 in inward radial direction 64 to the position of FIG. 4. Actuator 122 is actuated thus rotating arms 132, 134 so that the arms engage pins 80 and drive pins 72 from holes 74. Assembly 46, together with segments 48, 50, is driven in inward radial direction 64 until segments 48, 50 clear remainders 52, 54 of rings 8, 10 so to leave gaps 66. Rings 8, 10 are then rotated through their ring gears 12 to a coil load/unload station 158 aligned with core 34. Core clamp cylinder 144 is then released allowing core support assembly 36 and core 34 therewith to be removed from interior 146 of rings 8, 10. Doing so permits core 34 to be reoriented or replaced. Assembly 36 once again inserts a portion of core 34 into interior 146 and core clamp cylinder 144 is actuated to secure assembly 36 in the position of FIG. 1. Rings 8, 10 are rotated back to the position of FIG. 4 opposite assembly 46. Assembly 46 and segments 48, 50 therewith are moved in outward radial direction 86 until segments 48, 50 are replaced into engagement with remainders 52, 54 of rings 8, 10. Actuator 122 is then actuated so to rotate ends 136, 138 of arms 132, 134 outwardly away from pins 80 thus permitting springs 78 to drive pins 72 into holes 74. Simultaneously, actuators 98, 100 rotate arms 110, 112 against pins 80 to ensure pins 72 are fully seated in holes 74, after which actuators 98, 100 rotate arms 110, 112 away from pins 80. Assembly 46 is then moved in outward radial direction 86 by actuator 88 thus removing separator 148 from between rings 8, 10. Rings 8, 10 are then rotated to an initial or home position, typically to begin loading wire 16 into cavity 14 of wire magazine ring 10.

Figure 11A:
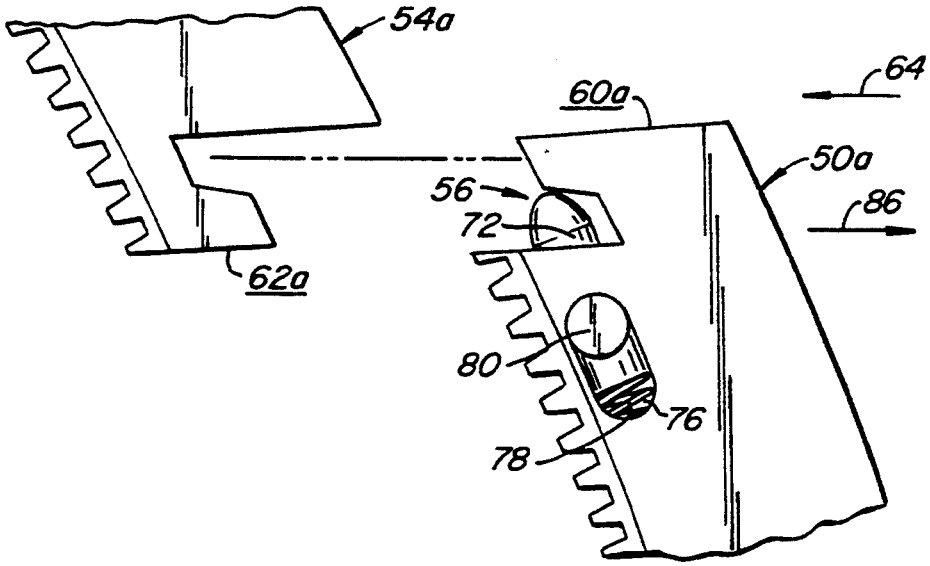
FIG. 11A is a view similar to FIG. 4 illustrating the configuration of the interface between the segment and the remainder of the ring for an alternative embodiment in which the interface is configured to permit the segment to be removed radially outwardly, as opposed to the radially inwardly movement of the embodiment of FIG. 4.
Figure 11B:
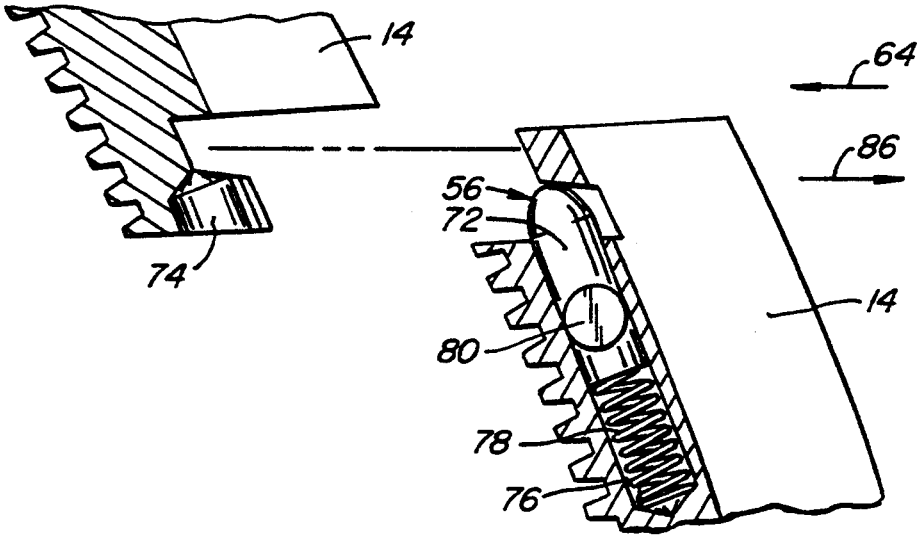
FIG. 11B is a cross-sectional view of the components shown in FIG. 11A.

FIGS. 11A and 11B illustrate a segment **50*a* and a remainder 54*a* of wire magazine ring 10*a* for an alternative embodiment of the invention. In this alternative embodiment, the tapered interfaces 60*a*, 62*a* are configured to permit segment 50*a* to move radially outwardly, that is in the direction of arrow 86, instead of radially inwardly as illustrated in FIG. 4. As can be seen, the two embodiments are very similar with like components identified with like reference numerals. The embodiment of FIGS. 11A and 11B is generally preferred since the wire in wine magazine ring 10*a* keeps segment 50*a* in place even if pin assemblies 56 work loose from holes 74 during use. The operation of removing and replacing segment 50*a* from ring 10*a* proceeds substantially identically as with segment 50 except for the direction of movement of the ring segment. This operation will be discussed below with reference to FIG. 15**.

Figure 12:
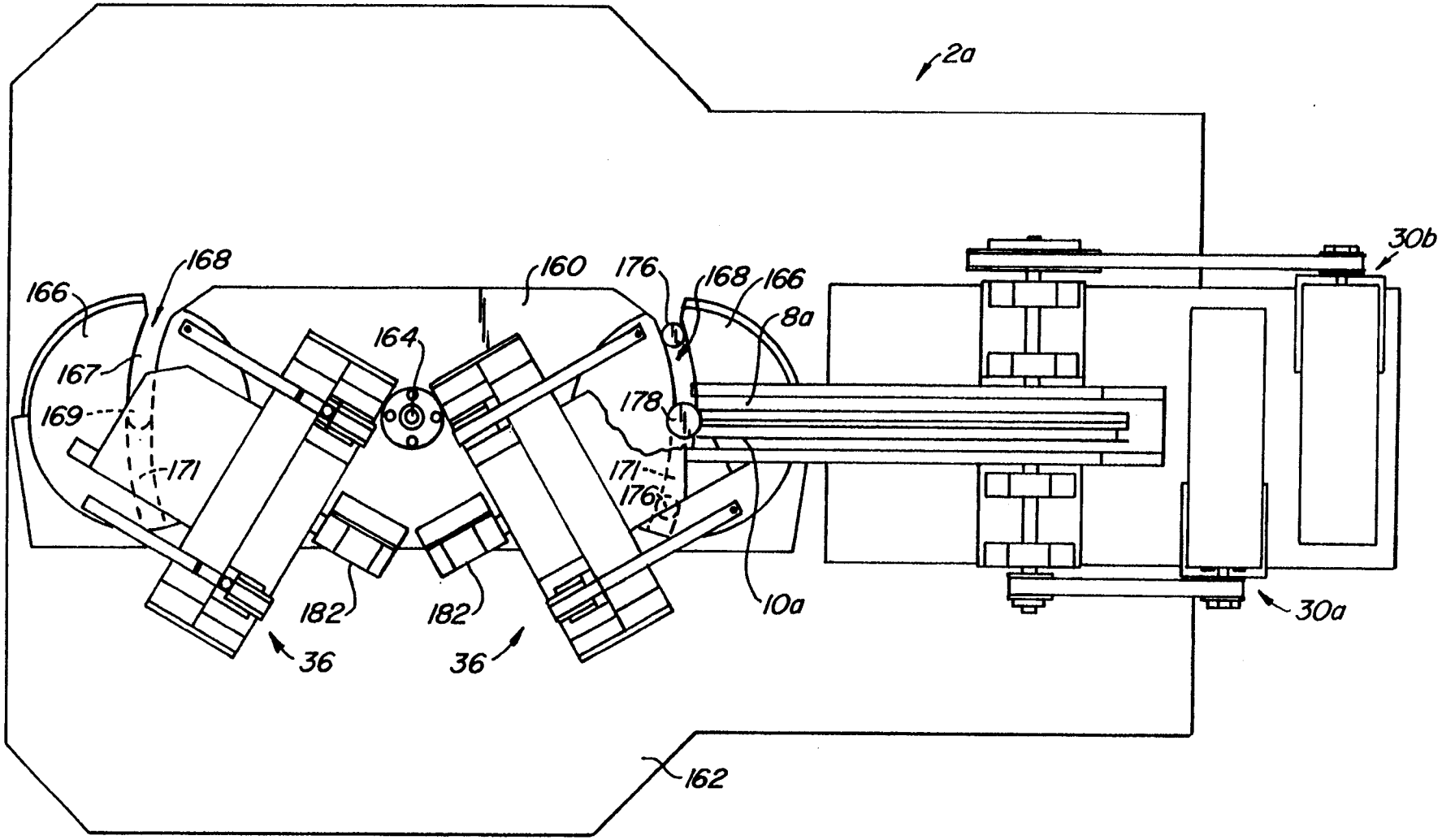
FIG. 12 is a top plan view of an alternative embodiment of the invention (but without the segment removal assembly of FIG. 1) in which a common support is used to support two core support assemblies of FIG. 1 to permit one core to be wound at the wire winding position while the other core support assembly has its previously-wound core removed and a new core mounted thereto.
Figure 13:
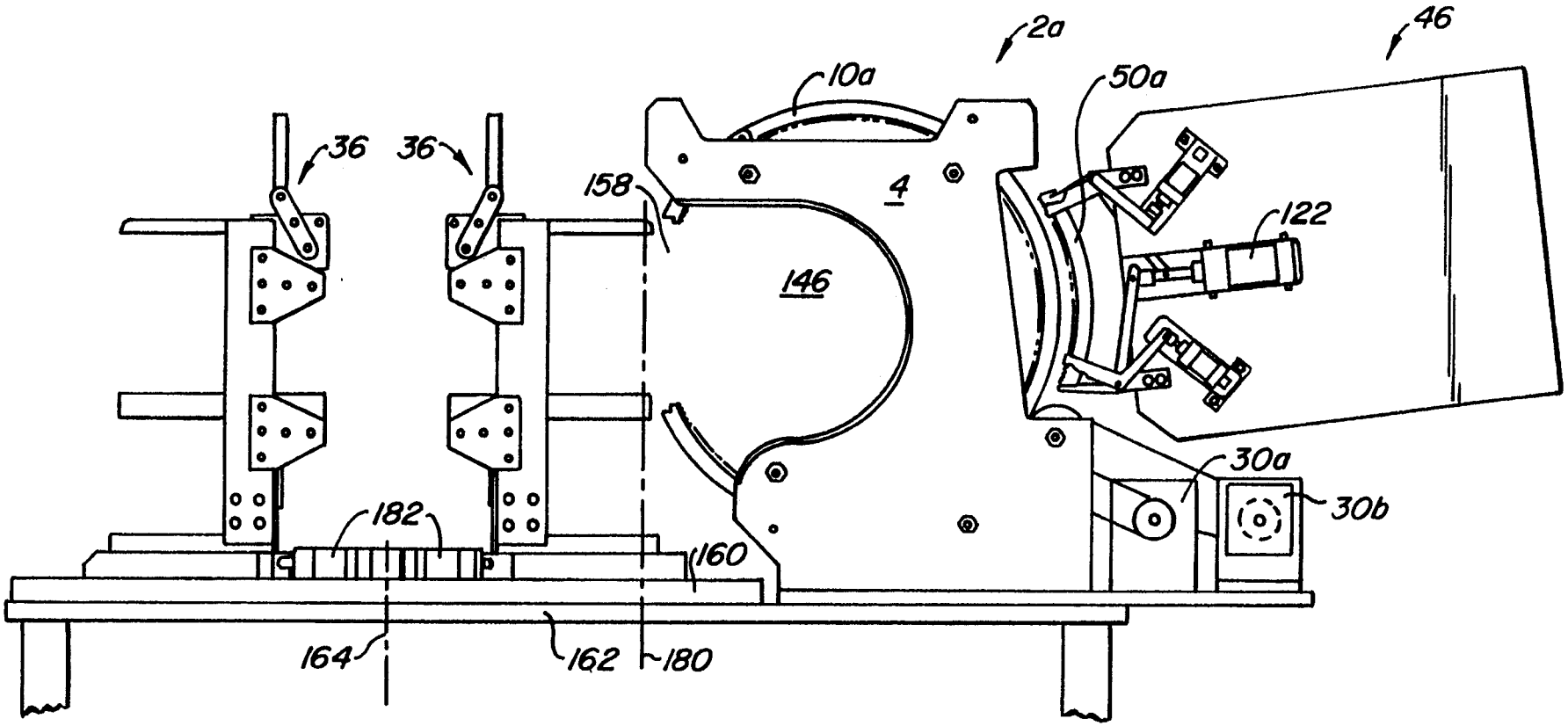
FIG. 13 is a somewhat simplified side view of the embodiment of FIG. 12 (but with the segment removal assembly of FIG. 1) with the core support assemblies rotated until they are generally aligned with a plane defined by the shell and magazine rings.

FIGS. 12 and 13 illustrate coil winding machine **2*a* in plan and elevational views. FIG. 13 shows rings 8*a*, 10*a* with segments 48*a*, 50*a* removed from remainders 52*a*, 54*a*; remainders 52*a*, 54*a* have been rotated to a coil load/unload station 158 aligned with a core support assembly 36. Core 34 is not shown in FIGS. 12 and 13 for the sake of clarity. Also, segment removal assembly 46 is not shown in FIG. 12; core support assemblies 36 in FIG. 13 have been rotated from the positions of FIG. 12 so that they are aligned with a plane defined by shuttle and wire magazine rings 8*a*, 10*a***, again for clarity of illustration.

Figure 14:
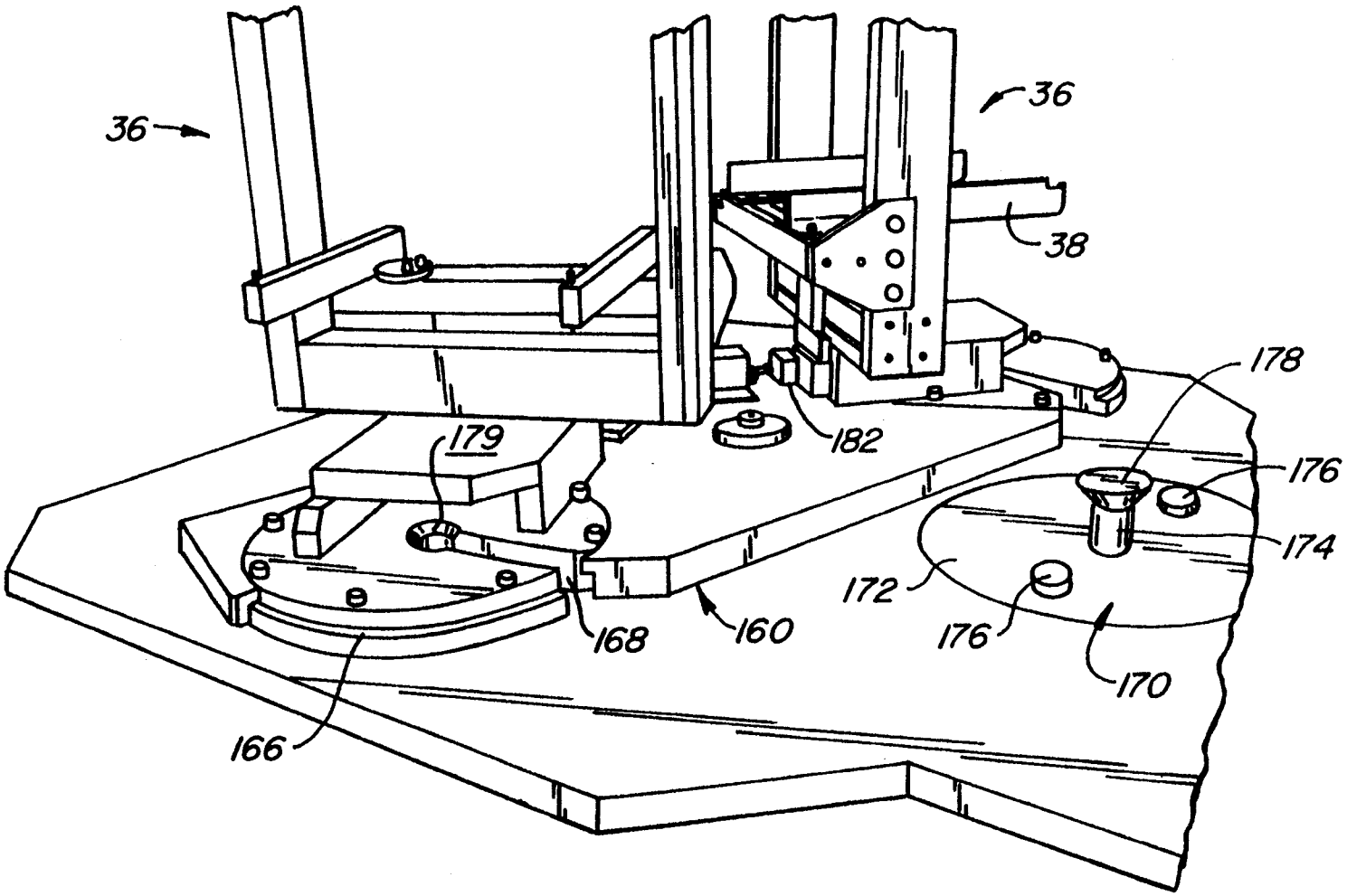
FIG. 14 is a perspective view showing the common support rotated about 90° clockwise from the position of FIG. 2.

Core support assemblies 36 are each mounted to a common support 160, see FIG. 14. The common support is pivotally mounted to a support surface 162 for pivotal movement in a 180° arc about a vertical axis 164. Doing so alternately positions one or the other of core support assemblies 36 at load/unload station 158 where winding operations are carried out. The core support assembly 36 that is not at station 158 can have the previously wound core 34 removed from the core support assembly and reoriented or a new core 34 can be mounted to assembly 36. In this way, winding operations on a core 34 may not be hindered by activities involving mounting cores to and dismounting cores from a core support assembly 36.

Referring now to FIG. 14, common support 160 is shown rotated about 90° in a clockwise direction from the position of FIG. 12. Common support 160 is shown to include a slotted, rotatable disk-like support 166 which is generally freely rotatably mounted to the remainder of common support 160. Disk-like support 166 includes a curved slot 168 having a through portion 167 extending outwardly from the center 169 of support 166 and formed completely through the support. Slot 168 has a lower extension 171 extending along the underside of support 166 from center 169. Support surface 162 has a core support driver 170 positioned at load/unload station 158. Driver 170 includes a circular, rotatable plate 172, a center shaft 174 and a pair of drive pegs 176 adjacent the periphery of plate 172. Drive pegs 176 are sized to fit within slots 168 and within extensions 171 of slots 168. Rotating common support 160 in a counterclockwise direction relative to FIG. 14 places the common support in the position of FIG. 12 with a drive peg 176 near each end of slot 168 and center shaft 174 at the center 169 of support 166. When in this position a conical member 178, mounted to the upper end of center shaft 174, is pulled down against support 166 into engagement with a conical surface 179 at center 169 of support 166 thus centering and securing the support in place. Rotation of plate 172 causes support 166 and core support assembly 36 therewith to rotate about an axis 180 of center shaft 174 during winding operations.

It is desirable to ensure that except when one of the disk-like supports 166 is at station 158, supports 166 be secured to common support 160 against any rotation. This is done to ensure that supports 166 are properly oriented when common support 160 is rotated to prevent damage to the equipment. This is achieved using a pair of air cylinders 182 mounted to common support 160. Air cylinders 182 drive pins (not shown) into openings (not shown) formed in core support assemblies 36 to prevent supports 166 from rotating except when at station 158.

Figure 15:
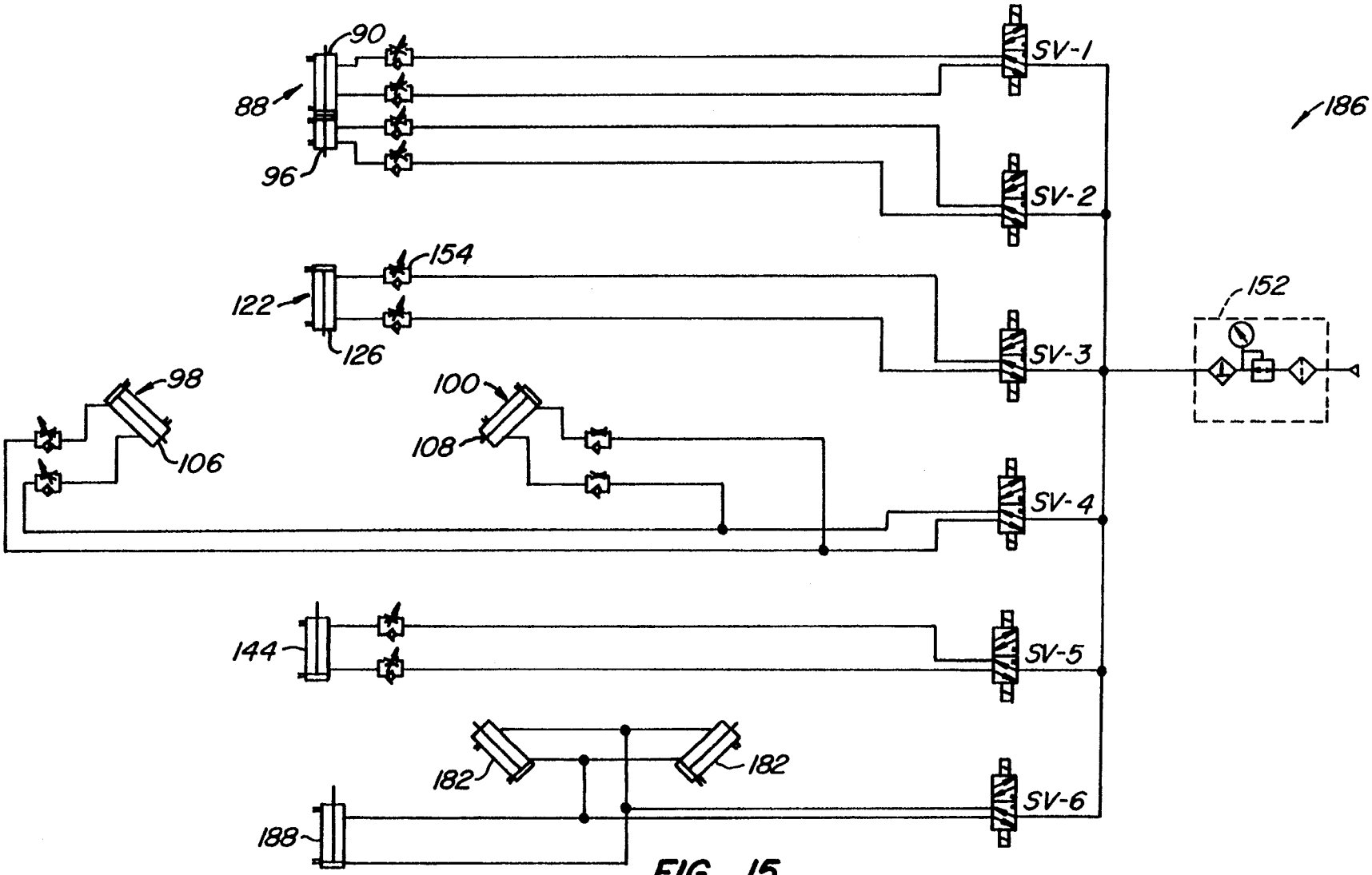
FIG. 15 is a schematic fluid power diagram similar to FIG. 10 but for the embodiment of FIGS. 11–14.

FIG. 15 illustrates a schematic diagram of a control circuit 186 which is quite similar to control circuit 150 shown in FIG. 10. Control circuit 186 includes shuttle valves S3-1 through S3-6, air actuated under control of controller 32. The shuttle valves are supplied with pressurized fluid from pressurized fluid source 152. The air from source 152 passes through the shuttle valves, through conventional flow controllers 154 and into the various actuators.

Operation of the invention under control of flow controller 32 using control circuit 186 proceeds as follows. Rings 8*a*, 10*a* are rotated until segments 48*a*, 50*a* are aligned with segment removal assembly 46. Base 82 is moved in an inward radial direction 64 by actuator 88. Actuator 122 is actuated thus rotating arms 132, 134 so that the arms engage pins 80 and drive pins 72 from holes 74 and pins 80 against arms 110, 112; arms 110, 112 do not pivot during this segment removal sequence. Assembly 46, together with segments 48*a*, 50*a*, is driven in an outward radial direction 86 until segments 48*a*, 50*a* clear remainders 52*a*, 54*a* of rings 8*a*, 10*a* so to leave gaps 66. Rings 8*a*, 10*a* are then rotated through their ring gears 12 to a coil load/unload station 158 aligned with core 34. Air cylinder 144 is released to allow common support 160 to rotate relative to support surface 162. Shuttle valve SC6 is actuated causing air cylinders 182 to temporarily lock supports 166 to support 160 in the positions of FIG. 12. Simultaneously the air cylinder 188 releases conical member 158 from disk-like support 166 to permit common support 160 to be rotated 180°. Common support 160 is then rotated 180°, which allows a previously wound core to be moved from load/unload station 158 and be replaced by a to-be-wound core at the station. Once common support has been rotated 180°, thus placing a to-be-wound core at load/unload station 158, air cylinder 144 is actuated to pin together common support 160 and support surface 162 so to keep common support 160 and support surface 162 from rotating relative to one another. Shuttle valve SV6 is then deactuated causing the release of air cylinders 182 and the actuation of air cylinder 188 thus securing the newly positioned disk-like support 166 at station 158 to core support drive 170. Rings 8*a*, 10*a* are then rotated back into position opposite assembly 46. Assembly 46 and segments 48*a*, 50*a* are then moved in an inward radial direction 64 by actuator 88 until segments 48*a*, 50*a* reengage remainders 52*a*, 54*a* of rings 8*a*, 10*a*. Actuator 122 is then actuated so to rotate ends 136, 138 of arms 132, 134 outwardly away from pins 80 thus permitting springs 78 to drive pins 72 into holes 74. Simultaneously, actuators 98, 100 rotate arms 110, 112 against pins 80 to ensure pins 72 are fully seated in holes 74, after which actuators 98, 100 rotate arms 110, 112 away from pins 80. Assembly 46 is then moved in outward radial direction 86 thus removing separator 148 from between rings 8*a*, 10*a*. Rings 8*a*, 10*a* are then rotated to an initial or home position, typically to begin loading wire 16 into cavity 14 of wire magazine ring 10*a*.

Modification and variation can be made to the disclosed embodiments without departing from the subject of the invention as defined in the following claims. For example, other types of securing and clamping arrangements, in lieu of combination assembly 56 can be used. The particular arrangement of arms and actuators used to engage and move segments 48, 50 can be changed as well.

What is claimed is:

1. In a coil winding machine of the type including a frame supporting independently driven shuttle and magazine rings, the improvement comprising:

the shuttle and magazine rings including shuttle and magazine ring segments removably mounted to remainders of the shuttle and magazine rings;

movable ring latching elements securing the segments to the remainders of the rings, the ring latching elements each being movable between a released position, at which the segments can be removed from the remainders of the rings, and a latched position, at which the segments are secured to the remainders of the rings;

ring segments removal means for:

grasping the ring segments when said segments are at shuttle and magazine ring removal positions;

moving the ring latching elements from the engaged position to the released position;

displacing the ring segments from the remainder of the rings thereby leaving segment gaps in the rings;

reinserting the ring segments into the segment gaps, thereby closing the segment gaps;

returning the ring latching elements from the released position to the engaged position;

releasing the ring segments; and the ring latching elements including segment grasping elements configured for engagement by the removal means.

2. The improvement of claim 1 wherein the ring latching elements include spring biased latch pins.

3. The improvement of claim 1 wherein the ring latching elements are spring biased from the released positions toward the latched positions.

4. The improvement of claim 1 wherein the removal means includes:

a base;

movable arms movably mounted to the base and having portions configured to engage the segment grasping elements; and arm driver means, coupled to the arms, for causing portions of the arms to engage the segment grasping elements and move the ring latching elements and the segment grasping elements therewith from the latched position to the released position.

5. The improvement of claim 4 wherein the arm driver means includes a piston and cylinder drive mounted to the base and coupled to the movable arms.

6. The improvement of claim 1 further comprising a ring separator positionable between the rings.

7. A method for providing access to the interior of shuttle and magazine rings of a coil winding machine, the rings each including removable shuttle and magazine ring segments and shuttle and magazine ring remainders, comprising the following steps:

positioning the rings at predetermined shuttle and magazine ring segment removal positions;

unlatching the ring segments from the ring remainders by engaging latching elements carried by the segments and moving the latching elements so to disengage the latching elements from the ring remainders;

displacing the ring segments to provide gaps in the rings;

rotating the ring remainders until the gaps are at predetermined access positions;

accessing the interior of the rings through the gaps;

returning the ring remainders to the removal position;

replacing the ring segments in said gaps; and relatching the ring segments to the ring remainders.

8. The method of claim 7 wherein the unlatching, displacing, replacing and relatching steps are automatically carried out under control of a controller which controls the coil winding machine.

9. The method of claim 7 further comprising the step of returning the rings to predetermined home positions after the relatching step.

10. The method of claim 7 wherein the displacing step includes the step of supporting the segments through the latching elements.

11. The method of claim 7 wherein the accessing step includes the step of:

removing a first toroidal transformer core from the interior of the rings; and positioning a portion of a second toroidal transformer core within the interior of the rings.

12. The method of claim 11 wherein the removing and positioning steps are carried out by moving a common support, to which the first and second toroidal transformer cores are mounted, between a first position and a second position.

13. The method of claim 12 wherein the common support moving step is carried out by rotating the common support.

14. A core support assembly for supporting two or more toroidal transformer cores during coil winding operations comprising:

a common support movable between first and second positions;

first and second rotary support elements each rotatably mounted to the common support and each including a center and a curved slot extending outwardly from the center;

a core support assembly mounted to each of said first and second rotary support elements, said core support assemblies each configured to removably mount a toroidal transformer core thereto for support during winding operations at a coil winding position;

the first and second rotary support elements being positioned at the coil winding position when the common support is at the first and second positions, respectively; and a drive peg and a center shaft, positioned at the coil winding position, sized and positioned to pass into the curved slots of rotary support elements as said rotary support elements are alternately moved to the coil winding position with the center shaft located at the centers of the rotary support elements, the drive pegs being rotatable about an axis passing through the center shaft so move the rotary support element and the core support mounted thereto about the axis at the coil winding position during coil winding operations.

15. The core support assembly of claim 14 wherein the common support is rotatable between the first and second positions.

16. The core support assembly of claim 14 further comprising means for preventing the rotation of the first and second rotary support elements relative to the common support except when one of the first and second rotary support elements is at the coil winding position.

17. In a coil winding machine of the type including a frame supporting independently driven shuttle and magazine rings, the improvement comprising:

the shuttle and magazine rings including shuttle and magazine ring segments removably mounted to remainders of the shuttle and magazine rings;

removable ring latching elements securing the segments to the remainders of the rings, the ring latching elements each being movable between a released position, at which the segments can be removed from the remainders of the rings, and a latched position, at which the segments are secured to the remainders of the rings;

a ring separator; and ring segments removal means for:

grasping the ring segments when said segments are at shuttle and magazine ring removal positions;

positioning the ring separator between the rings;

moving the ring latching elements from the engaged position to the released position;

displacing the ring segments from the remainder of the rings thereby leaving segment gaps in the rings;

reinserting the ring segments into the segment gaps, thereby closing the segment gaps;

returning the ring latching elements from the released position to the engaged position; and releasing the ring segments.

* * * * *